US011846189B2

(12) United States Patent
Pucher et al.

(10) Patent No.: US 11,846,189 B2
(45) Date of Patent: Dec. 19, 2023

(54) CUTTING ASSEMBLY FOR A MINING MACHINE

(71) Applicant: SANDVIK MINING AND CONSTRUCTION G.M.B.H., Zeltweg (AT)

(72) Inventors: Friedrich Pucher, Fohnsdorf (AT); Stefan Steiner, Polstal (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 0 days.

(21) Appl. No.: 17/793,692

(22) PCT Filed: Jan. 20, 2020

(86) PCT No.: PCT/EP2020/051223
§ 371 (c)(1),
(2) Date: Jul. 19, 2022

(87) PCT Pub. No.: WO2021/148104
PCT Pub. Date: Jul. 29, 2021

(65) Prior Publication Data

US 2023/0048925 A1 Feb. 16, 2023

(51) Int. Cl.

| | |
|---|---|
| ***E21D 9/11*** | (2006.01) |
| ***E21C 35/02*** | (2006.01) |
| ***E21D 9/08*** | (2006.01) |
| ***E21C 27/22*** | (2006.01) |
| *E21D 9/10* | (2006.01) |

(52) U.S. Cl.
CPC ..... *E21C 35/02* (2013.01); *E21C 27/22* (2013.01); *E21D 9/0875* (2016.01); *E21D 9/108* (2013.01)

(58) Field of Classification Search
CPC . E21C 35/02; E21C 27/22; E21D 9/11; E21D 9/1006; E21D 9/087
See application file for complete search history.

(56) References Cited

U.S. PATENT DOCUMENTS

| | | |
|---|---|---|
| 2,707,626 A | 5/1955 | Cartlidge |
| 2,736,542 A | 2/1956 | Cartlidge |

(Continued)

FOREIGN PATENT DOCUMENTS

| | | |
|---|---|---|
| CN | 107339112 A | 11/2017 |
| GB | 991569 A | 5/1965 |

*Primary Examiner* — Sunil Singh
(74) *Attorney, Agent, or Firm* — Corinne R. Gorski

(57) ABSTRACT

A cutting assembly for a mining machine includes a central hub having at least one arm extending radially outwards from the central hub. The arm includes at least one cutting means carrier movably arranged for radial movement along the arm and a primary actuator configured to control the radial position of the cutting means carrier. The cutting assembly further includes a locking means movable between an unlocked and a locked position, wherein the locking means in its locked position locks the cutting means carrier to the arm such that radial movement of the cutting means carrier is prevented. The locking means includes at least one locking member provided on the arm such that the locking member is movable between an extended position and a withdrawn position. The locking member in the extended position extends to engage the cutting means carrier such that movement of the cutting means carrier is prevented.

16 Claims, 6 Drawing Sheets

(56) References Cited

U.S. PATENT DOCUMENTS

| | | | | |
|---|---|---|---|---|
| 2,765,156 | A | 10/1956 | Cartlidge | |
| 4,316,635 | A | 2/1982 | LeBegue et al. | |
| 6,431,654 | B1 * | 8/2002 | LeBegue ..... | E21C 27/124 299/80.1 |
| 8,231,179 | B2 | 7/2012 | Willison et al. | |

* cited by examiner

CUTTING ASSEMBLY FOR A MINING MACHINE

RELATED APPLICATION DATA

This application is a § 371 National Stage Application of PCT International Application No. PCT/EP2020/051223 filed Jan. 20, 2020.

TECHNICAL FIELD

The present disclosure relates to ground boring, such as underground boring in mines. Specifically, the disclosure targets technology for boring at different diameters.

BACKGROUND

Underground boring is commonly done for mining purposes and a challenge is how to efficiently remove ground material and transport it out of the mine. Mining machines exist which are provided with one or more rotating cutting assemblies for cutting material in front of the mining machine as the mining machine gradually advances further into the formation whilst cuttings are removed and transported away.

The material and structure of the ground varies by location and the mining machines thus have to be adapted for operation at different sites where the material and structure of the ground of the respective locations differ. One parameter which can thus be adapted according to local circumstances is the cutting diameter.

A mining machine may be provided with a cutting assembly comprising a central hub comprising at least one arm extending radially outwards from the central hub. The arm is provided with at least one cutting means carrier movably attached to the arm for radial movement along the arm. The arm is also provided with an actuator configured to control the radial position of the cutting means carrier. The cutting assembly further comprises screws for locking the cutting means carrier in any one of a plurality of predetermined positions of the arm. Such a cutting assembly allows the cutting diameter to be changed by radially moving the cutting means carrier between the predetermined positions.

A problem with such cutting assemblies is that the adjustment of the movable cutting means carrier is cumbersome and time consuming. When an adjustment is needed throughout the cutting process then also the cutting process will be delayed.

SUMMARY

It is an object of the invention to provide an improved cutting assembly allowing easy adjustment of the cutting diameter during the cutting process. The cutting assembly comprises a central hub comprising at least one arm extending radially outwards from the central hub. The arm is provided with at least one cutting means carrier movably attached to the arm for radial movement along the arm. Also, the arm is provided with a primary actuator configured to control the radial position of the cutting means carrier. The cutting assembly further comprises a locking means movable between an unlocked position and a locked position, wherein the locking means in its locked position locks the cutting means carrier to the arm such that radial movement of the cutting means carrier is prevented, and wherein the locking means in its unlocked position allows movement of the cutting means carrier radially along the arm.

Also, the locking means comprises at least one locking member provided on the arm such that the locking member is movable between an extended position and a withdrawn position, wherein the locking member in the extended position extends to engage the cutting means carrier such that movement of the cutting means carrier is prevented. The movable locking member allows for quick and safe engagement and disengagement of the locking means at different radial positions of the cutting means carrier.

The locking means may comprise a biasing means configured to bias the locking member towards its extended position. The biasing means enables the locking member to move from its unlocking position towards its locking position and to be forced against the cutting means carrier.

The locking means may be provided with a hydraulic release system configured to increasingly force the locking member towards its withdrawn position upon increase of fluid pressure in the hydraulic release system.

The hydraulic release system enables remote control of the release of the locking means by increase of the fluid pressure in the hydraulic system and provides a robust solution able to achieve high forces for moving the locking member to its withdrawn position such that jamming of the locking member is mitigated.

The hydraulic release system may comprise a hydraulic actuator, wherein a first end portion of the hydraulic actuator is connected to the arm, wherein an opposite second end portion of the hydraulic actuator is connected to the locking member.

Since the opposite end portions of the hydraulic actuator are connected to the arm and to the locking member respectively, any change of length of the actuator brings about a corresponding movement of the locking member. The hydraulic actuator provides a robust means for achieving said movement of the locking means.

The locking means may comprise a plurality of said locking members, wherein the plurality of locking members are arranged in at least a first group of locking members and a second group of locking members, wherein the first group of locking members is connected to a first hydraulic circuit and wherein the second group of locking members is connected to a second hydraulic circuit such that the hydraulic release systems of the locking means of the first and second groups are individually controllable by control of the fluid pressures in the first and second hydraulic circuits respectively.

Such a configuration of the locking members allows locking members of one of said groups to be operated to their unlocked position independently of the locking members of the other group. Such operation of the locking members enables an iterative locking-sliding operation of the locking members such that when a group of locking members moves to their unlocked position, the locking members of the other group may slide along the cutting means carrier until they engage features of the cutting means carrier such as holes, recesses or protrusions. Thereby, the actuator can simply keep moving the cutting means carrier radially inwards or radially outwards until a locking means snaps into its extended locking position. Thus, there is no need of exactly synchronizing the position of the cutting means carrier and the operation of the locking members, which in turn provides for a simpler and more robust design with less need of calibration.

The cutting means carrier may comprise one or more locking recesses into which at least one of the at least one locking members is movable for engagement with the cutting means carrier.

The recess provides a well-defined position in which the locking member is able to mechanically engage the cutting means carrier for preventing radial movement of the cutting means carrier. The locking recess thus provided a robust mechanical engagement between the cutting means carrier and the arm.

The cutting means carrier may comprise a plurality of said locking recesses, wherein said plurality of locking recesses are distributed along at least a portion of the radial extent of each respective arm.

The provision of a plurality of locking recesses so distributed along the arm enables a higher number of radial locking positions using fewer locking members.

The cutting means carrier may be provided with one or more guide surfaces extending to and/or between the one or more locking recesses, wherein the guide surfaces are configured such that the one or more locking members are slidable along the guide surfaces to the one or more locking recesses upon radial movement of the cutting means carrier with the locking members forced against the guide surfaces.

The guide surface enables at least some of the locking members to be biased against the cutting means carrier whilst the cutting means carrier is radially moved such that each respective locking member eventually moves into one of the locking recesses.

The biasing means may comprise a coil spring. Alternatively, the biasing means may comprise a hydraulic actuator configured to increasingly force the locking member towards its extended position upon increase of hydraulic pressure in the hydraulic actuator.

The cutting assembly may comprise a plurality of said arms. The increased number of arms provide an increased cutting surface and thus increases lifetime of the cutting assembly.

The plurality of arms may be evenly distributed about a central axis of the cutting assembly. Such arrangement of the arms balances the arms to avoid vibrations in the cutting assembly.

According to a second aspect of the invention, the object is also achieved by a mining machine including at least one cutting assembly. Further, the mining machine may be a borer miner or a bolter miner.

According to a third aspect of the invention, the object is also achieved by a method of operating the above described cutting assembly. The method is a method of operating the above described cutting assembly and the method comprises the steps of:

a) disengaging all engaged locking member by moving the engaged locking members from their extended positions to their retracted positions thereby disengaging the cutting means carrier,
b) operating the primary actuator to radially move the cutting means carrier to a new radial position, and
c) moving at least one locking member to its extended position such that the locking member engages the cutting means carrier.

The step a) may be performed by operating the hydraulic release system while performing at least part of the movement of step b).

Also, step c) may be performed by biasing the locking members against their extended position whilst moving the cutting means carrier according to step b) until one or more locking members engage the cutting means carrier.

BRIEF DESCRIPTION OF DRAWINGS

FIGS. 6 and 10 show the second group of locking members in a state forced to their withdrawn positions, thereby enabling radial movement of the cutting means carrier. At the same time, the first group of locking members are biased against the cutting means carrier such that they can engage the locking recess(es) of the cutting means carrier once in a suitable position.

FIG. 8 shows the first group of locking members in a state forced to their withdrawn positions, thereby enabling radial movement of the cutting means carrier. At the same time, the second group of locking members are biased against the cutting means carrier such that they can engage the locking recess(es) of the cutting means carrier once in a suitable position.

FIGS. 7 and 9 show different radial positions of the cutting means carrier, with the locking members engaging the locking recess och the cutting means carrier.

FIG. 12 shows radial inwards movement of the cutting means carrier, wherein a chamfered portion of the locking recess enabled radial inwards movement of the cutting means carrier to force the engaged locking member towards its withdrawn position.

| | |
|---|---|
| 1 | cutting assembly |
| 2 | borer miner |
| 3 | central hub |
| 4 | arm |
| 5 | cutting means carrier |
| 6 | primary actuator |
| 7 | locking means |
| 8 | locking member |
| 9 | central axis |
| 10 | biasing means |
| 11 | hydraulic release system |
| 12 | hydraulic actuator |
| 13 | first group |
| 14 | second group |
| 15 | first hydraulic circuit |
| 16 | second hydraulic circuit |
| 17 | locking recess |
| 18 | guide surface |
| 19 | inclined transfer surface |

DETAILED DESCRIPTION

Figure 1:
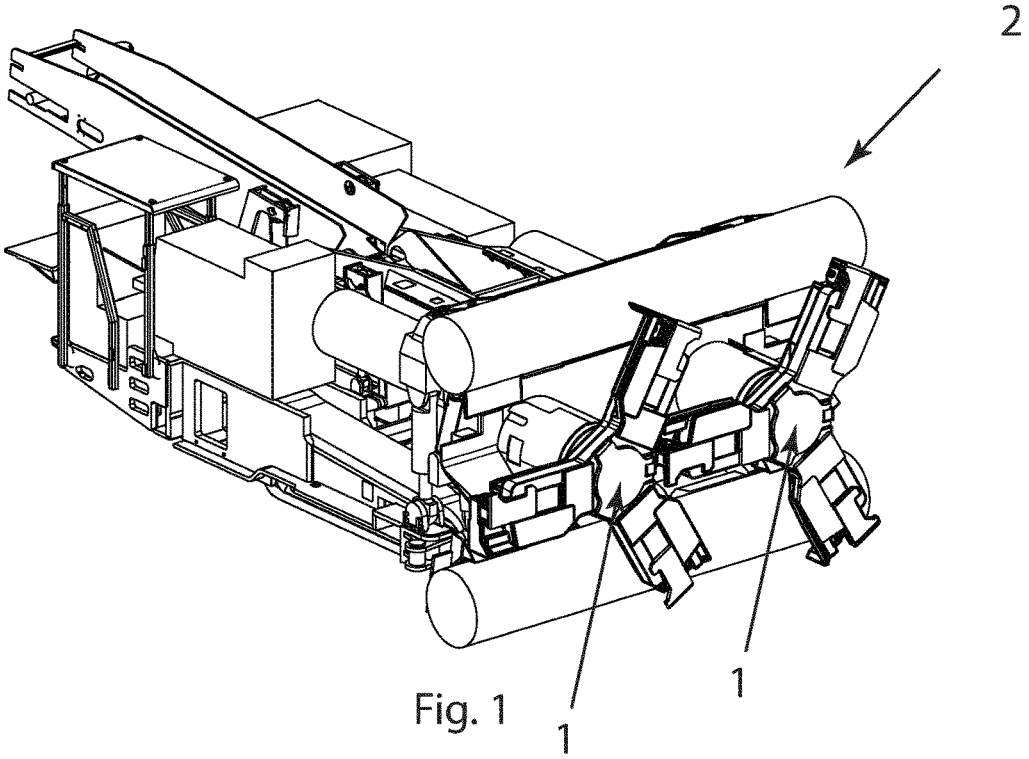
FIG. 1 shows a mining machine fitted with two cutting assemblies according to a first embodiment.

A cutting assembly 1 according to a first embodiment will hereinafter be described with reference to the appended drawings. The cutting assembly 1 is for use in a mining machine such as a borer miner or a bolter miner. FIG. 1 shows a borer miner with a left and a right cutting assembly, each cutting assembly being provided with three arms 4. The arms 4 are evenly distributed about the rotational axis of each cutting assembly 1 and the left and right cutting assemblies 1 are rotationally aligned such that the arms 4 of each cutting assembly 1 mesh in use. The present disclosure will focus its description on one cutting assembly 1 and one of its arms 4. However, the two cutting assemblies 1 are alike and may be connected to a central control system for controlling the operation of their arms, separately or together. In other embodiments the number of arms 4 may vary.

Figure 5:
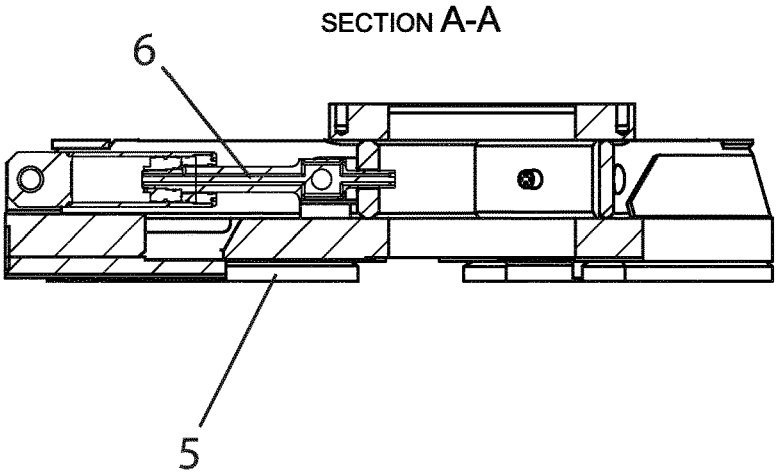
FIG. 5 shows a cross-sectional view in section A-A of the cutting assembly shown in FIG. 4, wherein the actuator for radial movement of the cutting means carrier is visible.

The arm 4 is provided with one cutting means carrier 5 movably attached to the arm 4 for radial movement along the arm 4. As shown in FIG. 5, the arm 4 is also provided with a primary actuator 6 configured to control the radial position of the cutting means carrier 5. The cutting assembly 1 comprises a locking means 7 movables between an unlocked position and a locked position, wherein the locking means 7 in its locked position locks the cutting means carrier 5 to the arm 4 such that radial movement of the cutting means carrier 5 is prevented, and wherein the locking means in its unlocked position allows movement of the cutting means carrier 5 radially along the arm 4. In this embodiment, the locking means 7 comprises four locking members 8 provided on the arm 4 such that the locking members 8 are movable between an extended position and a withdrawn position, wherein each locking member 8 in its extended position extends to engage the cutting means carrier 5 such that movement of the cutting means carrier 5 is prevented. The movable locking member 8 allows for quick and safe engagement and disengagement of the locking means 7 at different radial positions of the cutting means carrier 5.

In use, each cutting assembly 1 is provided with cutting means, such as drill bits, attached to the cutting means carrier 5. Depending on the characteristics of the material cut, the radial extent of each cutting assembly 1 may need to be adjusted by movement of the cutting means carriers 5 of each arm 4.

The locking means 7 comprises biasing means 10 configured to bias the locking members 8 towards their extended positions. In the first embodiment, the biasing means 10 comprises a coil spring configured to bias each locking member 8 towards its extended position. In other embodiments, such as in the second embodiment shown in FIG. 2-3, the biasing means 10 instead of a coil spring comprises a hydraulic actuator 12 configured to increasingly force the locking member 8 towards its extended position upon increase of hydraulic pressure in the hydraulic actuator 12.

The locking means 7 is also provided with a hydraulic release system 11 configured to increasingly force the locking member 8 towards its withdrawn position upon increase of fluid pressure in the hydraulic release system 11. The hydraulic release system 11 comprises one hydraulic actuator 12 for each locking member 8, wherein a first end portion of the hydraulic actuator 12 is connected to the arm 4, wherein an opposite second end portion of the hydraulic actuator 12 is connected to the locking member 8. In this embodiment, one actuator is used as the biasing means 10 and as the hydraulic actuator of the hydraulic release system 11. In other embodiments, two separate hydraulic actuators could be used for performing each function, or the respective actuators could be replaced by respective electromechanical actuators.

Figure 7:
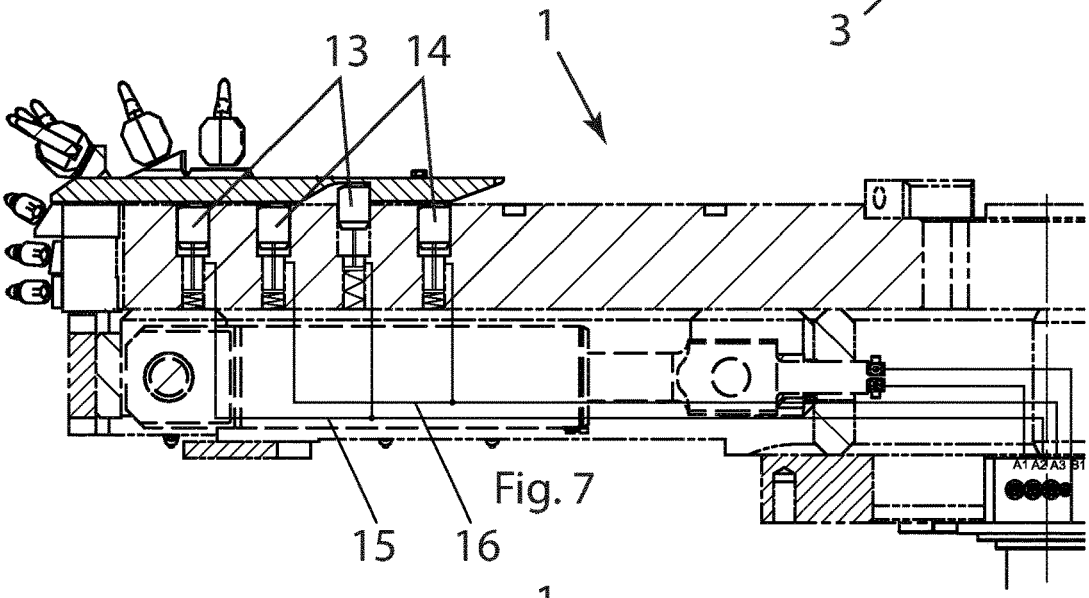

In the first embodiment, the plurality of locking members 8 are arranged in at least a first group 13 of locking members 8 and a second group 14 of locking members, as shown in FIG. 7. The first group 13 of locking members is connected to a first hydraulic circuit 15 and wherein the second group 14 of locking members is connected to a second hydraulic circuit 16 such that the hydraulic release systems 11 of the locking members 8 of the first 13 and second 14 groups are individually controllable by control of the fluid pressures in the first and second hydraulic circuits 15, 16 respectively.

Such a configuration of the locking members allows locking members of one of said groups to be operated to their unlocked position independently of the locking members of the other group. Such operation of the locking members enables an iterative locking-sliding operation of the locking members such that when a group of locking members moves to their unlocked position, the locking members of the other group may slide along the cutting means carrier until they engage features of the cutting means carrier such as holes, recesses or protrusions. Thereby, the actuator can simply keep moving the cutting means carrier radially inwards or radially outwards until a locking member snaps into its extended locking position. Thus, there is no need of exactly synchronizing the position of the cutting means carrier and the operation of the locking members, which in turn provides for a simpler and more robust design with less need of calibration.

Figure 2:
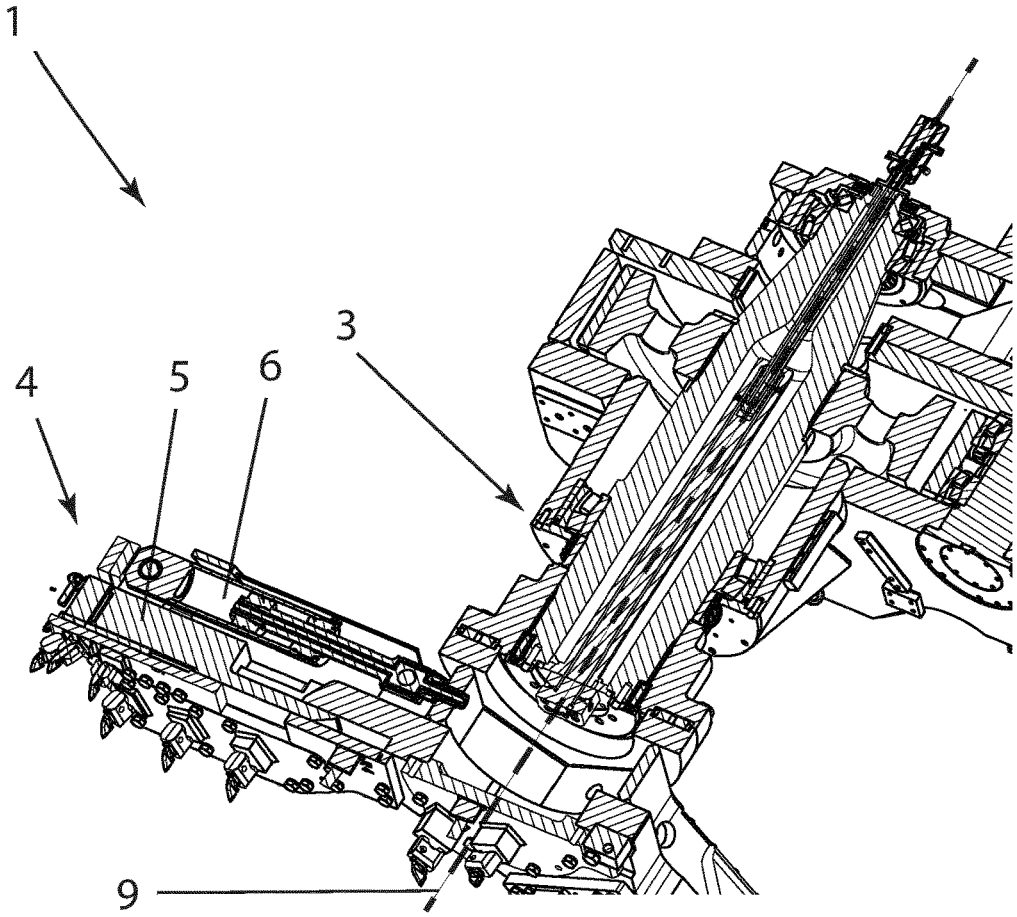
FIG. 2 shows a cross-sectional view of a cutting assembly according to a second embodiment.
Figure 3:
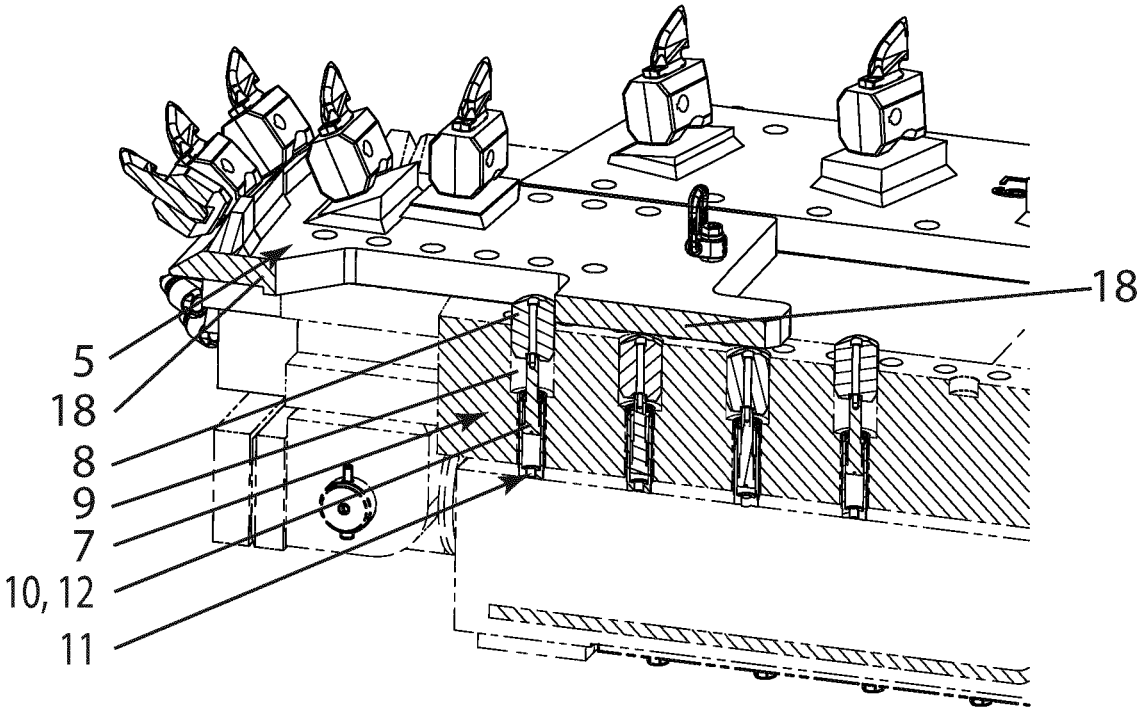
FIG. 3 shows an enlarged view of an end portion of the cutting assembly also shown in FIG. 2.
Figure 4:
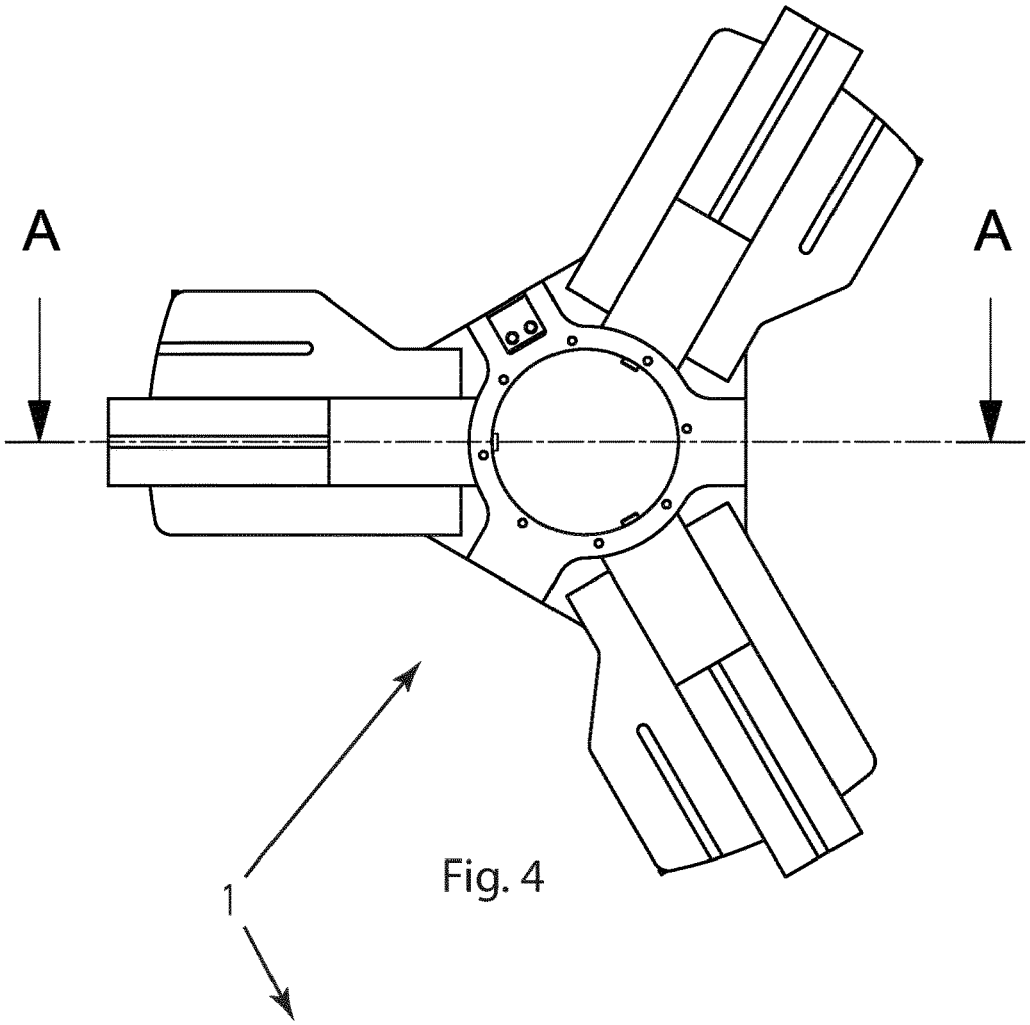
FIG. 4 shows a front view of a cutting assembly according to the first embodiment, however with cutting means/drill bits not shown.

In the second embodiment, shown in FIGS. 2-3, all four locking members 8 are arranged in one group only, and hence can only be controlled together, for example by simultaneously increasing fluid pressure to force all four hydraulic actuators of the locking means towards their extended position.

Figure 6:
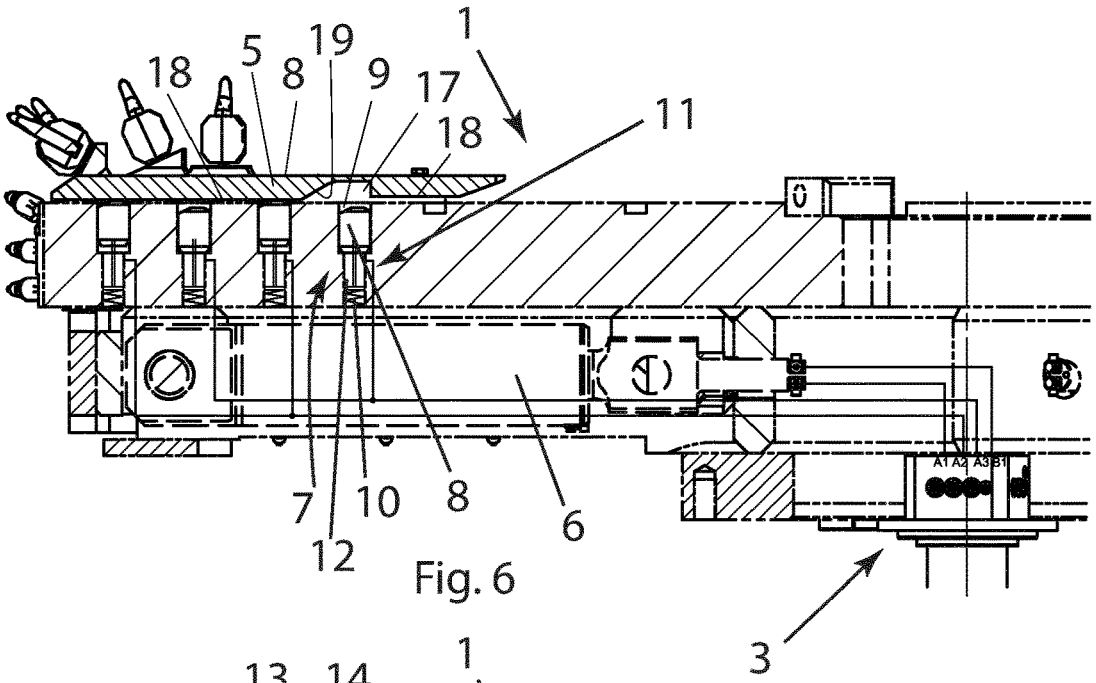
FIGS. 6-12 show an outer portion of the cutting assembly also shown in FIGS. 1-5, with cutting bits and in different radial positions and with its locking mechanism in different states of operation. Reference numerals specified in FIGS. 6-7 are not repeated throughout other ones of FIGS. 6-9 since it is obvious from FIGS. 6-7 what features relate to what reference numerals.

In the first embodiment, as shown in FIGS. 6 and 7, the cutting means carrier 5 comprises one locking recess 17 into which one of the locking members 8 is movable at a time for engagement with the cutting means carrier 5. The recess provides a well-defined position in which the locking member is able to mechanically engage the cutting means carrier for preventing radial movement of the cutting means carrier. The locking recess thus provided a robust mechanical engagement between the cutting means carrier and the arm.

In other embodiments, the cutting means carrier 5 may instead comprise a plurality of locking recesses 17, wherein said plurality of locking recesses 17 are distributed along at least a portion of the radial extent of each respective arm 4. The provision of a plurality of locking recesses so distributed along the arm enables a higher number of radial locking positions using fewer locking members.

The cutting means carrier 5 is provided with a guide surface 18 extending to between from the radially innermost end portion of the cutting means carrier towards the locking recess 17. The guide surface 18 is configured such that the one or more locking members 8 are slidable along the guide surfaces 18 to the one or more locking recesses 17 upon radial movement of the cutting means carrier 5 with the locking members 8 forced against the guide surfaces 18. The guide surface 18 enables at least some of the locking members 8 to be biased against the cutting means carrier 5 whilst the cutting means carrier 5 is radially moved such that each respective locking member 8 eventually moves into the locking recess.

Operation of the cutting assembly for adjustment of the radial position of the cutting means carrier 5 of each arm will in the following be described with reference to FIGS. 6-12.

In FIG. 6, the second group 13 of locking members 8 are forced to their released position using the hydraulic actuators controlled by a hydraulic control system. This sets the rightmost locking member 8 free of the locking recess 17 of the cutting means carrier 5 such that the cutting means carrier 5 can be freely moved radially inwards or radially outwards.

Once the locking members 8 have been retracted as shown in FIG. 6, the cutting means carrier 5 is moved at least slightly radially outwards such that the rightmost locking member 8 can again be released without being forced back into its locking position in the locking recess 17. For example, the rightmost locking member 8 could slide against the guide surface 18 radially inwards of the locking recess 17 whilst the cutting means carrier 5 is moved further radially outwards until the cutting means carrier 5 reaches the position shown in FIG. 7 in which a locking member 8 from the first group 13 of locking members 8 has moved into its locking position in the locking recess 17. Hence, both groups of locking members 8 may be forced against the guide surfaces 18 of the cutting means carrier whilst radial movement continues wherein only one of the locking members 8 will eventually enter the locking recess 17 and thereby prevent further movement radially outwards of the cutting means carrier 5.

Figure 8:
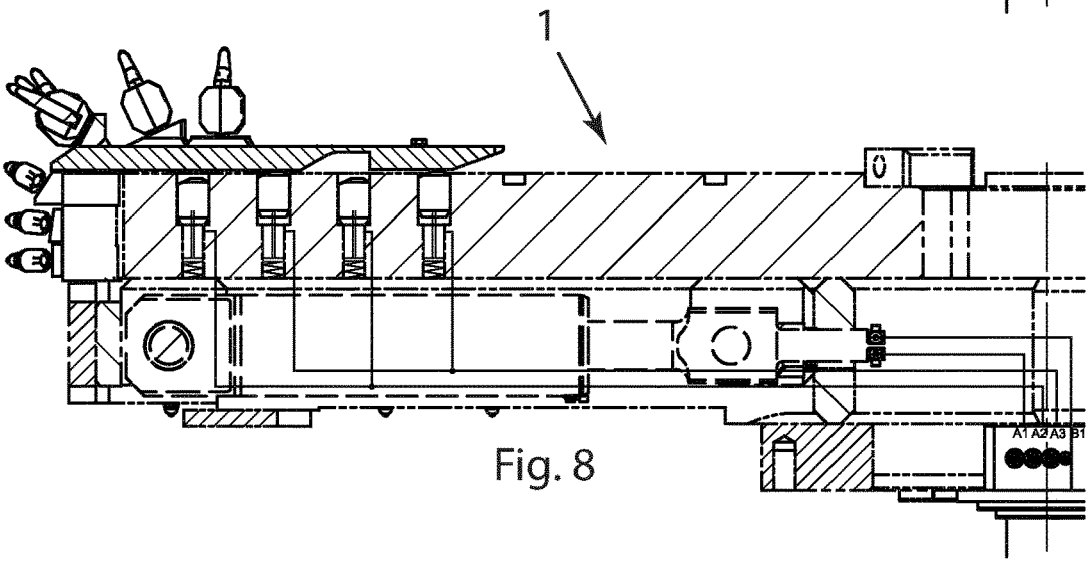

In order to continue radial movement outwards, the process is repeated however, by release of the just engaged first group 13 of locking members 8, wherein the second group 14 of locking members 8 may remain pressed against the guide surfaces 18 of the cutting means carrier 5 as shown in FIG. 8. From the position in FIG. 8, the cutting means carrier 5 is moved further radially outwards until it reaches the position shown in FIG. 9, in which the leftmost locking member 8 of the second group 14 of locking members 8 has moved into the locking recess 17 to thereby prevent further movement radially outwards of the cutting means carrier 5.

Figure 9:
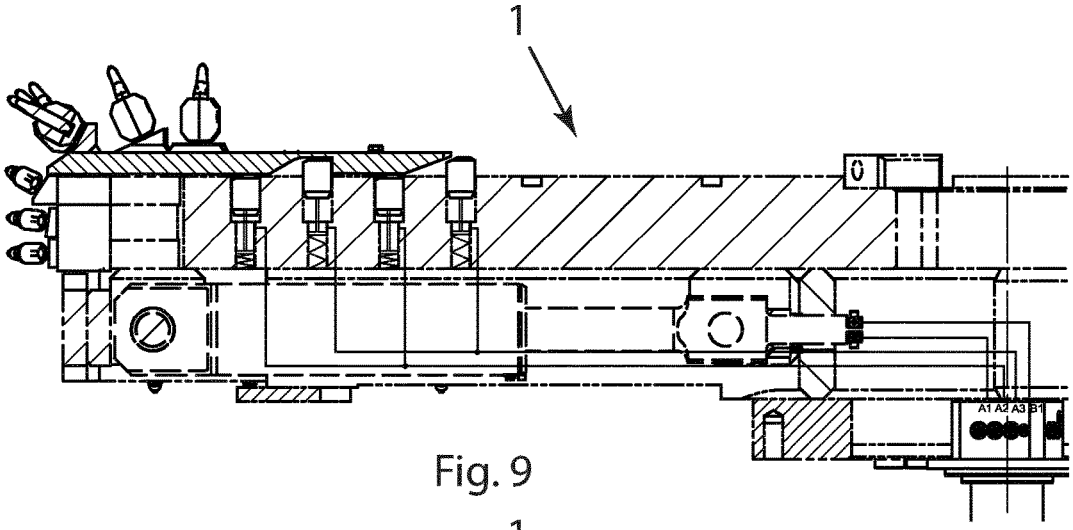
Figure 10:
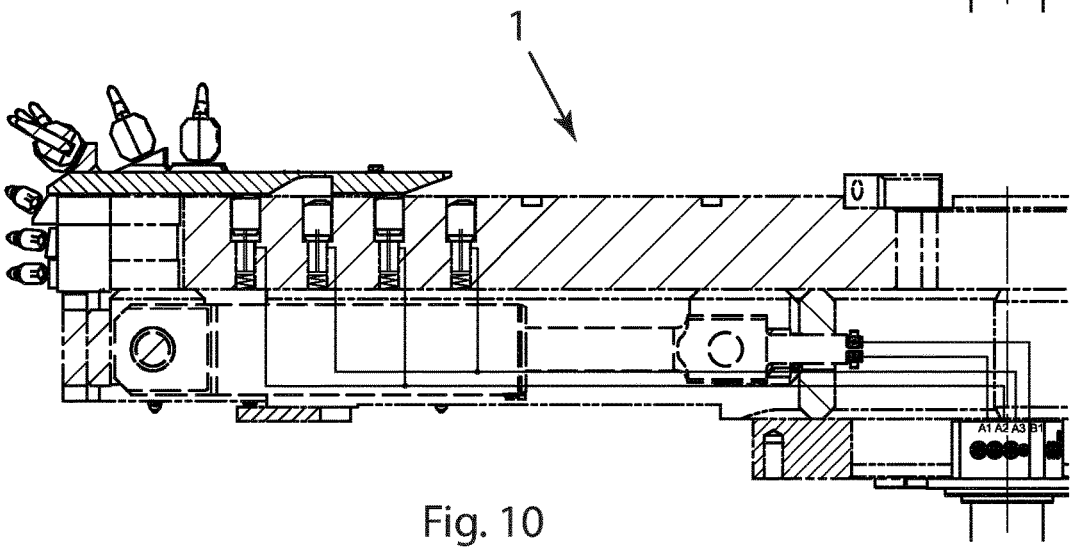
Figure 11:
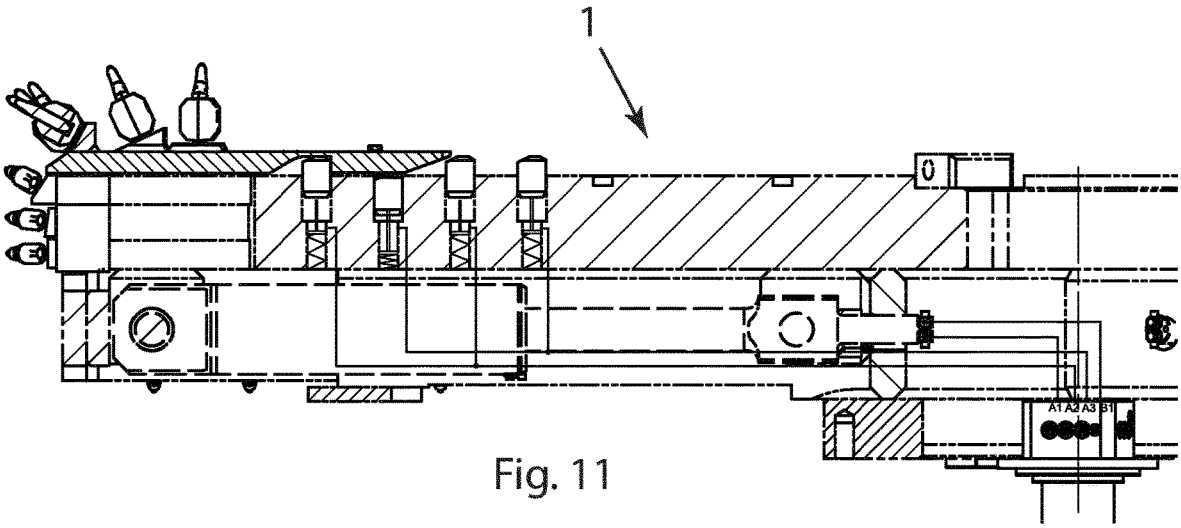

The above-mentioned steps are then repeated again to move the cutting means carrier 5 from the position shown in FIG. 9 to the one shown in FIG. 11.

Figure 12:
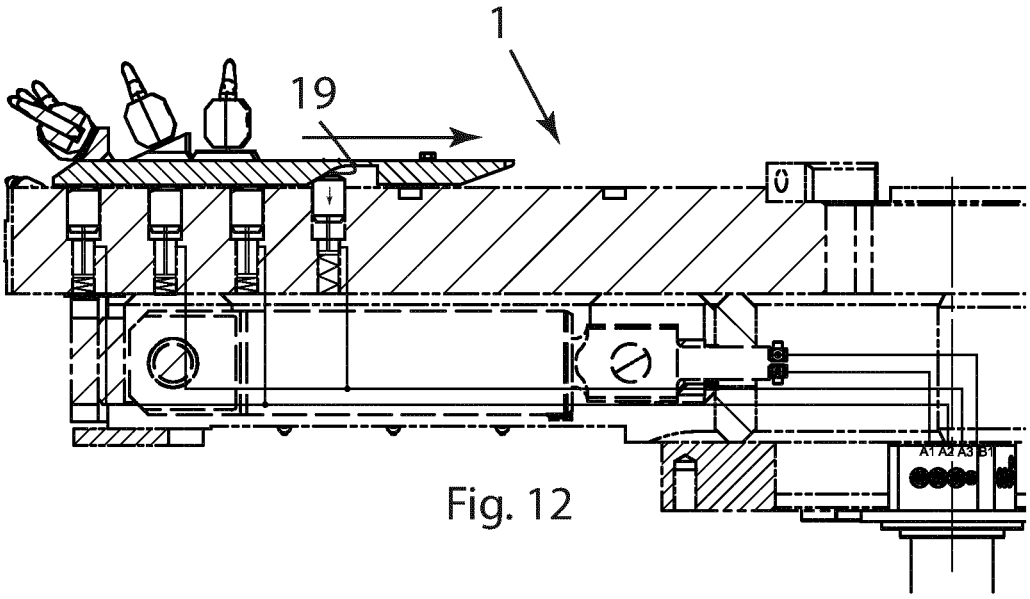

The cutting means carrier 5 could be moved radially inwards according to the same principles, by alternatingly using the hydraulic release system 11 to disengage the locking member 8 engaged wherein movement radially inwards of the cutting means carrier 5 may proceed. However, in the embodiment shown, the locking recess 17 is provided with an inclined transfer surface 19 between the bottom of the locking recess and the adjacent guide surface 18, said transfer surface being configured with such inclination as to allow the locking member 8 to be forced from its extended locking position to its withdrawn unlocked position at movement radially inwards of the cutting means carrier 5. Hence, in this embodiment, the inclined transfer surface is provided on the radially outermost portion of the locking recess 17. FIG. 12 shows such movement radially inwards of the cutting means carrier 5.

For the cutting assembly according to the second embodiment, comprising only one group of locking members 8, they all need to be disengaged simultaneously wherein radial movement of the cutting means carrier 5 may commence.

A hydraulic system is provided to pressurize the various hydraulic circuits as needed. Hydraulic pumps may be provided either on each arm, on the central hub or remotely such as on the mining machine. A valve assembly for controlling pressure to each hydraulic circuit is provided at each arm, as shown in FIGS. 6-12, but the valve assembly or valves could also be provided elsewhere, such as on the central hub or on the mining machine.

The invention claimed is:

1. A cutting assembly for a mining machine, said cutting assembly comprising:

a central hub including at least one arm extending radially outwards from the central hub, wherein the at least one arm is provided with at least one cutting means carrier movably attached to the at least one arm for radial movement along the at least one arm, wherein the at least one arm is provided with a primary actuator configured to control a radial position of the at least one cutting means carrier; and a locking device movable between an unlocked position and a locked position, wherein the locking device in its locked position locks the at least one cutting means carrier to the at least one arm such that radial movement of the at least one cutting means carrier is prevented, wherein the locking device in its unlocked position allows movement of the at least one cutting means carrier radially along the at least one arm, the locking device including at least one locking member provided on the at least one arm such that the at least one locking member is movable between an extended position and a withdrawn position, wherein the at least one locking member in the extended position extends to engage the at least one cutting means carrier such that movement of the at least one cutting means carrier is prevented, wherein the locking device includes a biasing means configured to bias the at least one locking member towards its extended position.

2. The cutting assembly according to claim 1, wherein the locking device is provided with a hydraulic release system configured to increasingly force the at least one locking member towards its withdrawn position upon increase of fluid pressure in the hydraulic release system.

3. The cutting assembly according to claim 2, wherein the hydraulic release system includes a hydraulic actuator, wherein a first end portion of the hydraulic actuator is connected to the at least one arm, and wherein an opposite second end portion of the hydraulic actuator is connected to the at least one locking member.

4. The cutting assembly according to claim 3, wherein the locking device includes a plurality of locking members, wherein the plurality of locking members are arranged in at least a first group of locking members and a second group of locking members, wherein the first group of locking members is connected to a first hydraulic circuit and wherein the second group of locking members is connected to a second hydraulic circuit such that the hydraulic release system of the locking members of the first and second groups are individually controllable by control of the fluid pressures in the first and second hydraulic circuits respectively.

5. The cutting assembly according to claim 1, wherein the at least one cutting means carrier includes one or more locking recesses into which a respective at least one locking member is movable for engagement with the at least one cutting means carrier.

6. The cutting assembly according to claim 5, wherein the at least one cutting means carrier is provided with one or more guide surfaces extending to and/or between the one or more locking recesses, wherein the one or more guide surfaces are configured such that one or more locking members are slidable along the one or more guide surfaces to the one or more locking recesses upon radial movement of the at least one cutting means carrier with the one or more locking members forced against the one or more guide surfaces.

7. The cutting assembly according to claim 1, wherein the at least one cutting means carrier includes a plurality of locking recesses, wherein said plurality of locking recesses are distributed along at least a portion of the radial extent of each respective at least one arm.

8. The cutting assembly according to claim 1, wherein the biasing means is a coil spring.

9. The cutting assembly according to claim 1, wherein the biasing means is a hydraulic actuator configured to increasingly force the at least one locking member towards its extended position upon increase of hydraulic pressure in the hydraulic actuator.

10. The cutting assembly according to claim 1, wherein the at least one arm includes a plurality of arms.

11. The cutting assembly according to claim 10, wherein the plurality of arms are evenly distributed about a central axis of the cutting assembly.

12. The mining machine comprising at least one cutting assembly according to claim 1.

13. The mining machine according to claim 12, wherein said mining machine is a borer miner or a bolter miner.

14. A method of operating a cutting assembly according to claim 2, the method comprising the steps of:

engaging the at least one cutting means carrier with the at least one locking member by moving the at least one locking member from the withdrawn position to the extended position, disengaging the engaged at least one locking member by moving the engaged at least one locking member from the extended positions to the withdrawn position thereby disengaging the at least one cutting means carrier;

operating the primary actuator to radially move the at least one cutting means carrier to a new radial position; and moving the at least one locking member to its extended position such that the at least one locking member engages the at least one cutting means carrier.

15. The method according to claim 14, wherein the step of disengaging the engaged at least one locking member is performed by operating the hydraulic release system while performing at least part of the step of moving the at least one cutting means carrier.

16. The method according to claim 14, wherein the at least one locking member comprises a plurality of locking members, and wherein the step of moving the at least one locking member to its extended position is performed by biasing the plurality of locking members against the extended position whilst moving the at least one cutting means carrier to the new radial position until one or more of the plurality of locking members engage the at least one cutting means carrier.

* * * * *